US012083577B2

(12) United States Patent
Gysi et al.

(10) Patent No.: US 12,083,577 B2
(45) Date of Patent: Sep. 10, 2024

(54) METHOD AND DEVICE FOR PRODUCING TEAR-OPEN LIDS

(71) Applicant: Soudronic AG, Bergdietikon (CH)

(72) Inventors: Peter Gysi, Bellikon (CH); Marcel Oberholzer, Bergdietikon (CH)

(73) Assignee: SOUDRONIC AG, Bergdietikon (CH)

( * ) Notice: Subject to any disclaimer, the term of this patent is extended or adjusted under 35 U.S.C. 154(b) by 240 days.

(21) Appl. No.: 17/778,438

(22) PCT Filed: Nov. 16, 2020

(86) PCT No.: PCT/EP2020/082266

§ 371 (c)(1),
(2) Date: May 20, 2022

(87) PCT Pub. No.: WO2021/099267

PCT Pub. Date: May 27, 2021

(65) Prior Publication Data

US 2022/0395889 A1 Dec. 15, 2022

(30) Foreign Application Priority Data

Nov. 22, 2019 (CH) ..... 01478/19

(51) Int. Cl.
*B21D 51/44* (2006.01)
*B21D 28/26* (2006.01)
*B21D 45/00* (2006.01)

(52) U.S. Cl.
CPC ..... *B21D 51/443* (2013.01); *B21D 28/265* (2013.01); *B21D 45/003* (2013.01)

(58) Field of Classification Search
CPC .... B21D 51/44; B21D 51/443; B21D 51/446; B21D 51/40; B21D 28/30; B21D 28/265; B21D 28/32
See application file for complete search history.

(56) References Cited

U.S. PATENT DOCUMENTS 6,705,979 B1 3/2004 Sakaguchi et al.
2014/0083602 A1* 3/2014 Lanz ..... B21D 51/443 156/443

FOREIGN PATENT DOCUMENTS

DE 2637085 A1 2/1978
DE 9203953 U1 7/1992
(Continued)

OTHER PUBLICATIONS

International Search Report mailed on Feb. 23, 2021, in connection with corresponding International Application No. PCT/EP2020/08226 (5 pp., including machine-generated English translation).

*Primary Examiner* — Debra M Sullivan
(74) *Attorney, Agent, or Firm* — McCormick, Paulding & Huber, PLLC

(57) ABSTRACT

A method for manufacturing a tear-off lid (27). A lid blank (9) is punched with a punching tool (1, 5) having a die (6) and a cutting punch (2, 3) to form a lid ring (8) with a central removal opening (17) surrounded by a sealing flange (18). The edge of the removal opening (17) is then formed by drawing to a collar (20) projecting from the sealing flange (18) on the intended inside of the lid (underside), the collar (20) is rolled up at its free end and a tear-off foil (24) is sealed or glued onto the sealing flange (18) on the intended outside of the lid (upper side).

In accordance with the invention, the die (6) is arranged on the inner side (bottom) of the lid and the cutting punch (2, 3) is moved into the die (6) from the outer side (top) of the lid while punching out a punched pad (16) and the punched pad (16) is conveyed by compressed air through the die (6) to a conveyor (33) by means of which it is removed from the tool area.

It has been shown that by this measure the known and established processes and devices for the production of tear-off lids can be modified with very little effort in such a (Continued)

way that during the punching of the lid blank (9) the punching or cutting pad is produced on the intended inner side (underside) of the produced lid ring (8), which is desirable when producing lids with “re-verse curl”.

25 Claims, 11 Drawing Sheets

(56) References Cited

FOREIGN PATENT DOCUMENTS

| | | | |
|---|---|---|---|
| DE | 29817592 | U1 | 11/1998 |
| WO | 2006/017953 | A1 | 2/2006 |
| WO | 2012/127672 | A1 | 9/2012 |
| WO | 2018/191828 | A1 | 10/2018 |

* cited by examiner

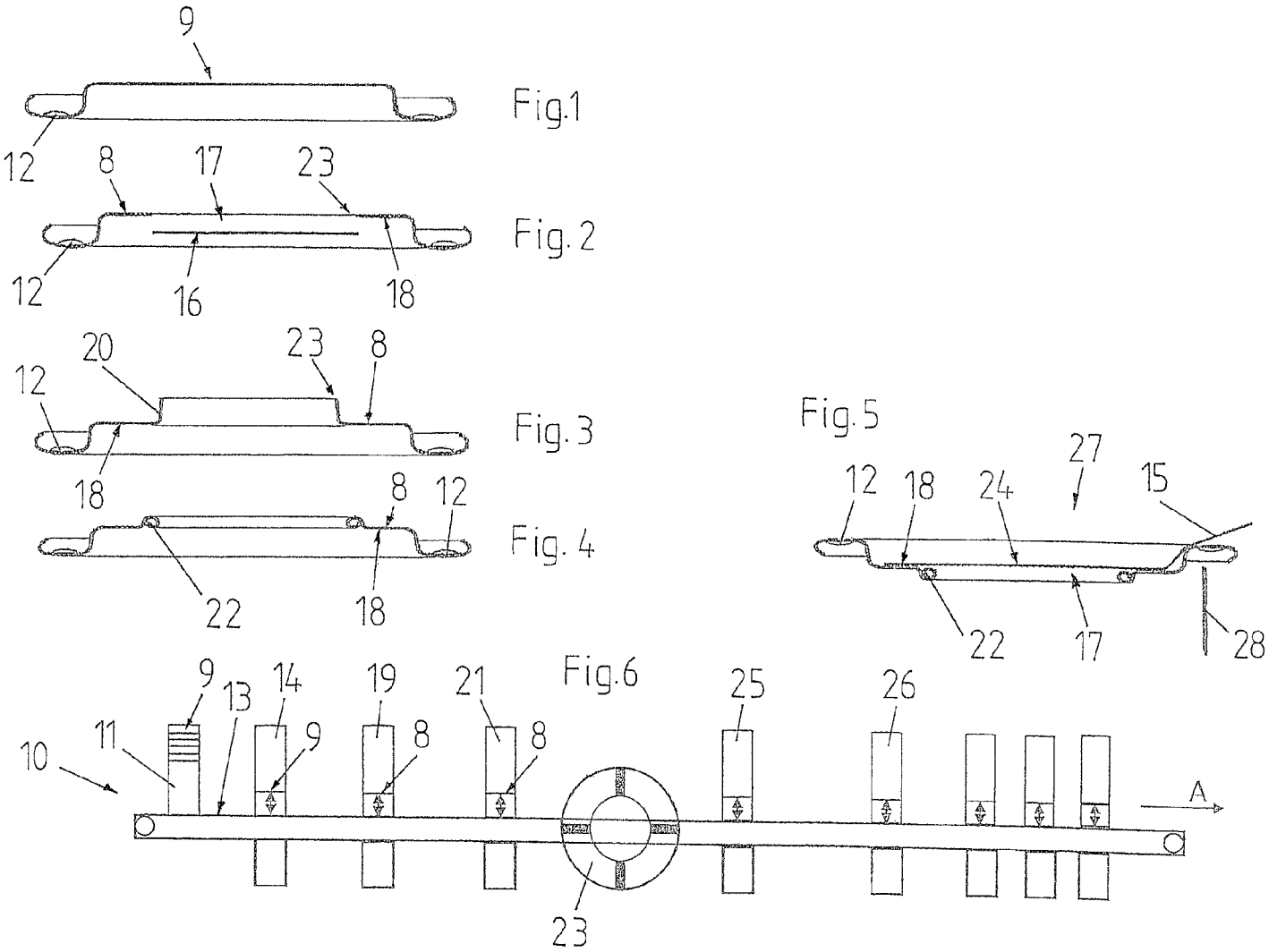
PRIOR ART

PRIOR ART

PRIOR ART

PRIOR ART

PRIOR ART

PRIOR ART

METHOD AND DEVICE FOR PRODUCING TEAR-OPEN LIDS

CROSS-REFERENCE TO RELATED APPLICATION

This application is a National Stage application of International Patent Application No. PCT/EP2020/082266, filed Nov. 16, 2020, which claims the priority of Swiss patent application 01478/19, filed Nov. 22, 2019, the disclosure of which is incorporated herein by reference in its entirety.

TECHNICAL FIELD OF THE INVENTION

The invention relates to a method for manufacturing tear-off lids, a device for manufacturing tear-off lids, in particular according to the method, a punching processing station for the device, and a tear-off lid manufactured or producible by the method according to the preambles of the independent claims.

BACKGROUND OF THE INVENTION

Tear-off lids (so called-peel off ends or POE) are known, e.g. from DE-U 298 17 592 or from DE-U 92 03 953.

With reference to FIGS. 1 to 6, a state-of-the-art production of tear-off lids known to the skilled person can be briefly explained.

FIG. 1 shows a lid blank 9. At the beginning of the transport path of a known manufacturing device 10, a stack 11 is shown, which contains a large number of such lid blanks 9, which are destacked individually and processed along the transport path by different processing stations 14, 19, 21, 25, 26, whereby the lid blanks 9 are first formed into lid rings 8 (see FIG. 2) and then processed further until the finished tear-off lid 27 (see FIG. 5). The lid blanks 9 are e.g. round or oval disks made of coated metal and thus protected against corrosion, especially made of coated tinplate or aluminium sheet. They have e.g. a diameter of 11 cm. These blanks 9 have already been preformed at their edge 12 by a not shown processing machine and the formation of the edge 12 will later be used to attach the finished tear-off lid 27 to a container 28 or a can by a seam connection. This is known to the skilled person and will not be further explained here.

The conveyor 13, which conveys the lid blanks, the lid rings and the tear-off lids in the manufacturing device 10 along the transport path in the direction of arrow A from one processing station to the next processing station, is formed in particular by two parallel running toothed belts, on which holders for the lid blanks or lid rings are provided, as the skilled person knows from WO 2006/017953. This will not be explained further here either. At the respective state-of-the-art processing stations, which are known to the skilled person and are only shown schematically here, the blank or ring to be processed is lifted off the conveyor, processed by the processing station and returned to the conveyor. This is indicated at the processing stations by arrows pointing up and down. In the case of the processing stations, the drive of the processing stations is indicated below the conveyor. This serves to lift and lower the blanks and lid rings and to carry out the respective processing steps.

In a punching processing station 14, a lid ring 8 is first formed from the lid blank 9 by punching a central part 16 of the blank downwards and disposing of it as waste (see FIG. 2). This forms the removal opening 17 of the tear-off lid, which is closed with the tear-off foil 24 in a later production step. A sealing flange 18 remains, following the removal opening 17. In a processing station 19, the edge of the removal opening 17 is pulled upwards to form a collar 20 (see FIG. 3). This collar 20 is rolled up in a further processing station 21 towards or away from the removal opening, to form a so-called "curl". This curl 22, which then forms the edge of the removal opening 17, ensures that the user of the can is protected from the sharp-edged cutting edge 23 when removing the contents of the can. Depending on the circumference of the curl, it is called a "C-curl" (cut edge not located within the curl) or a "retort-curl" (cut edge located within the curl), and "curls" that are rolled up away from the removal opening are called "reverse C-curl" or "reverse retort-curl". In the case shown here, a so-called Retort-Curl 22 is formed (see FIG. 4).

The previous manufacturing steps were carried out in a position in which the lid blanks 9 and lid rings 8 were arranged with their later top side or with the sealing flange 18 pointing downwards. This is a preferred embodiment also for the present invention. As mentioned above, the blank 9 or the ring 8 is lifted off the conveyor 13 in the individual processing stations 14, 19 and 21, processed and put back again, whereupon the conveyor carries out conveying steps, which lead the lid blanks 9 or lid rings 8 to the next processing station. If the manufacturing steps are carried out with the sealing flange 18 pointing downwards, as shown in the figure, a turning station 23 follows, which turns the lid rings 8, so that during further processing the sealing flange 18 is at the top after the turning station 23 in the conveyor 13 and in the processing stations 25, 26.

Then the tear-off foil 24 is sealed onto the sealing flange 18, which can be done in two steps with a pre-sealing station 25 and a main sealing station 26. The sealing method is also known to the skilled person and will not be explained further here. Further processing stations may follow in which the sealing foil 24 is embossed, the tear-off tab 15 is positioned and a leak test is performed. This is also known to the skilled person and will not be further explained here. At the end of the known manufacturing device 10, finished tear-off lids 27 are issued (see FIG. 5), whose removal opening 17 is spanned by a tear-off foil 24, which is sealed to the sealing flange 18. The edge of the removal opening 17 is formed by the retort curl 22. The finished tear-off lid 27 can be attached to a can body (which is indicated in FIG. 5 only by a wall part 28) by means of its seam edge 12 and thus seals the can. This is done in the filling station, in which the can has been filled with a filling material. The filled can can be opened later by tearing the tear-off foil 24 away from the lid ring 8 by means of its tear-off tab 15, thus exposing the removal opening 17.

With the state-of-the-art system described above, a punching or cutting pad is produced on the intended outside (underside) of the lid ring produced during punching of the lid blank, which is particularly suboptimal if a "reverse curl" (rolling up away from the removal opening) is subsequently produced. In this case, it would be desirable from a production point of view if the (unavoidable) punching or cutting pad would be produced on the intended inside (top side) of the produced lid ring, with otherwise unchanged method sequence or system concept.

SUMMARY

The invention has the objective of providing technical solutions by means of which the previously described known and established methods and devices for the production of tear-off lids can be modified with the least possible technical effort so that the punching or cutting pad is produced on the other side of the lid with essentially unchanged method sequence and system concept.

This objective is reached by the method, the device and the punching processing station according to the independent patent claims.

According to these claims, a first aspect of the invention concerns a method for manufacturing a tear-off lid. In this method, a lid blank is punched with a punching tool to form a lid ring with a central removal opening, which is surrounded by a sealing flange. The punching tool has a die and a cutting punch.

The edge of the removal opening is then shaped by drawing to form a collar which protrudes from the sealing flange on the side forming the inside of the lid (intended inside of the lid) when the lid is later used for the intended purpose.

The collar is then rolled up at its free end and then a tear-off film is sealed or glued onto the sealing flange on the side forming the outside of the lid (intended outside of the lid) during the later intended use of the lid to be produced.

According to the invention, during punching the die is placed on the side of the lid to be produced that forms the inner side of the lid during the later intended use (intended inner side of the lid), and the cutting punch is moved into the die from the side of the lid to be produced that forms the outer side of the lid during the later intended use (intended outer side of the lid) while a punched pad is being punched out.

The punched pad produced in this way is conveyed by compressed air through the die to a conveyor, by means of which it is removed from the tool area.

The invention makes it possible to modify the currently known and established methods and devices for the production of tear-off lids with very little effort in such a way that, with essentially unchanged method sequence and system concept, the punching or cutting pad is produced on the side forming the outside of the lid (intended outside of the lid) when the lid to be produced is later used in accordance with the intended purpose.

In a preferred embodiment of the method, a lid blank is used, which consists of a ferromagnetic material. A magnetic conveyor belt is used as a conveyor for removing the punched pad from the tool area. This allows a reliable handling and removal of the punched pad in the smallest space and with a minimum of moving parts.

In another preferred embodiment of the method, a vacuum conveyor belt is used as a conveyor for removing the punched pad from the tool area. This also allows a reliable handling and removal of the punched pad in the smallest space and with a minimum of moving parts and ferromagnetic as well as non-ferromagnetic lid blanks, e.g. of aluminium, can be processed.

Magnetic and vacuum conveyor belts are generally known in the field of conveyor technology and therefore need not be explained in detail here.

The compressed air, which is used to convey the punched pad to the conveyor, is advantageously fed through the cutting punch.

It is preferable that the compressed air that is led through the cutting punch is brought to the outlet on the side of the cutting punch facing the lid blank or the punched pad via one or more outlet openings. In this way, air can be applied directly to the side of the punching butt facing the cutting punch and thus reliably guided away from it.

It is advantageous that the compressed air, which is led through the cutting punch, is discharged on the side of the cutting punch facing the lid blank or the punched pad via three identical discharge openings, which have identical distances to each other. Such a configuration of the outlet openings effectively prevents the punched pad from skewing or tilting in the die.

Furthermore, in the embodiments of the method in which the compressed air passed through the cutting punch is discharged via one or more outlet openings on the side of the punch facing the lid blank or the punched pad, it is preferred that this compressed air, which is used to convey the punched pad to the conveyor, is provided intermittently. The advantage of this is that no compressed air is supplied when the tool is open and compressed air is supplied when the tool is closed. This simplifies the process control and saves energy as compared to a permanent supply.

It is also preferred that the compressed air is applied to the outlet openings only at the beginning of the punching process or, even more preferred, only after the punching process has been completed, preferably after the end of the movement of the cutting punch, which is the top dead center of the movement of the cutting punch in the case of cutting punches working upwards.

In the latter case, the punched pad is completely separated from the cover blank before compressed air is applied, which has the advantage that a cleanly controllable process sequence is possible.

In a first preferred variant of the method according to the invention, the collar, which is formed from the edge of the removal opening by drawing, is rolled up towards the removal opening, to form a C-Curl or a Retort-Curl.

In a second preferred variant of the method according to the invention, the collar formed from the edge of the removal opening by drawing is rolled up away from the removal opening into a reverse C-curl or a reverse retort curl. In this second variant, the advantages of the invention are particularly evident.

Furthermore, in the method according to the invention it is preferred that the cutting punch is moved and the die is stationary during punching, that the cutting punch penetrates the die from the bottom to the top during cutting and/or that the lid ring is turned between the rolling up of the collar and the sealing or gluing of the tear-off foil. This makes it possible to use today's known and established production systems with minor modifications at the punching processing station to carry out the method. An appropriate die-cutting processing station according to the invention is the subject of the third aspect of the invention, which will be explained later.

Preferably, after punching the lid ring is conveyed out of the cutting tool in a first transport direction and the punched pad is removed from the tool area by the conveyor in a second transport direction, which is transverse to the first transport direction, in particular perpendicular to the first transport direction. This has the advantage that the punched pad can be removed with the conveyor directly into the area in front or behind the production system.

A second aspect of the invention relates to a device for the production of tear-off lids, in which a tear-off foil is sealed or glued on the upper side of the lid on a sealing surface arranged around a removal opening. Preferably, the device is adapted for the production of tear-off lids according to the method of the first aspect of the invention.

The device comprises a first conveyor for lid blanks, lid rings and tear-off lids as well as processing stations, which are provided in succession in the conveying direction for processing the lid blanks, lid rings and tear-off lids. A first processing station is designed as a punching processing station for forming a lid ring with a central removal opening surrounded by a sealing flange from a lid blank by punching it with a punching tool comprising a die and a cutting punch. A second processing station of the device is adapted to form a collar protruding from the lid ring, a third processing station to roll the collar into a curl and a fourth processing station to seal or glue a tear-off foil onto the sealing flange. Such a device was described in the introduction using FIGS. 1 to 6.

In accordance with the invention, the first processing station is designed in such a way that during punching the die is arranged on the side of the lid to be produced that forms the inner side of the lid during the later intended use (intended inner side of the lid) and the cutting punch is arranged from the other side, thus from the side of the lid to be produced that forms the outer side of the lid during the later intended use (intended outer side of the lid), and is inserted into the die by punching out a punched pad. Devices are provided for conveying the punched pad by means of compressed air through the die to a second conveyor assigned to the first processing station, by means of which the punched pad is removed from the tool area during intended operation of the device.

Such devices for the production of tear-off lids have the advantages already mentioned in the method description and can be built from existing systems with very little modification, while the method sequence and system concept remain unchanged.

The second conveyor is preferably a magnetic conveyor belt or a vacuum conveyor belt, by means of which the punched pads can be removed from the tool area.

The cutting punch has advantageously one or more air ducts to transport the compressed air within it, which is used in the intended operation to convey the punched pad by means of compressed air through the die to the second conveyor.

For this purpose, the cutting punch has one or more outlet openings for the compressed air on its side facing the cover blank or the punched pad. In this way, the punched pad can be supplied with compressed air directly on its side facing the cutting punch and thus be reliably guided away from it to the second conveyor.

It is especially preferred if the cutting punch has several, e.g. three, especially identical outlet openings, which have identical distances to each other. Such a configuration of the outlet openings can effectively prevent the punched pad from tilting in the die.

Furthermore, it is preferable that the device has a control system by means of which, in intended operation, the compressed air used for conveying the punched pad to the second conveyor can be or is intermittently provided, preferably in such a way that no compressed air is provided when the tool is open and compressed air is provided when the tool is closed, in particular from the point when the end of movement of the cutting punch is reached. This simplifies the method control and saves energy.

In a first preferred variant of the device according to the invention, the third processing station is designed in such a way that the collar, which is formed from the edge of the removal opening by drawing, is rolled up towards the removal opening, to form a C-curl or a retort-curl.

In a second preferred variant of the device according to the invention, the third processing station is designed in such a way that the collar formed from the edge of the removal opening by drawing is rolled up away from the removal opening, to a reverse C-curl or to a reverse retort curl. The advantages of the invention are particularly evident in this second variant.

Furthermore, it is preferred that the device according to the invention is designed in such a way that the cutting punch is moved and the die is stationary during punching, that the cutting punch penetrates into the die from bottom to top during cutting and/or that the lid ring is turned in a turning station between the rolling up of the collar and the sealing or gluing of the tear-off foil. This makes it possible to convert today's known and established production lines with a slight modification of the punch processing station into a device in accordance with the invention. An appropriate punch processing station according to the invention is the subject of the third aspect of the invention, which will be explained later.

Preferably, the first conveyor has a first transport direction and the second conveyor has a second transport direction, which is transverse to the first transport direction, preferably perpendicular to the first transport direction. This has the advantage that the punched pads can be transported directly to the area in front of or behind the production line.

A third aspect of the invention concerns a punching processing station for a device according to the second aspect of the invention, for forming a lid ring with a central removal opening surrounded by a sealing flange from a lid blank by punching.

The punching processing station comprises a punching tool with a fixed die and a cutting punch, which, in the intended punching operation, works from below against the die and thereby moves into the die while punching out a punched pad.

In addition, it comprises devices for conveying the punched pad in the intended punching operation by means of compressed air against gravity through the die to a conveyor associated with the punching processing station, for removing the punched pad from the tool area.

Such punching processing stations can be used to convert production systems known and established today as described above into devices in accordance with the second aspect of the invention.

A fourth aspect of the invention concerns a tear-off lid manufactured or producible with the method according to the first aspect of the invention. Such tear-off lids represent an important trading form of the invention.

BRIEF DESCRIPTION OF THE DRAWINGS

Further embodiments, advantages and applications of the invention result from the dependent claims and from the following description of the figures. Thereby it is shown in:

FIG. 1 is a vertical section through a lid blank 9;

FIGS. 2 to 4 are vertical sections through a lid ring 8 in different stages of production;

FIG. 5 is a vertical section through a finished tear-off lid 27;

FIG. 6 is a schematic side view of a state-of-the-art device for the production of tear-off lids or for carrying out the steps according to FIGS. 1 to 5;

DESCRIPTION OF THE PREFERRED EMBODIMENTS

Figure 7A:
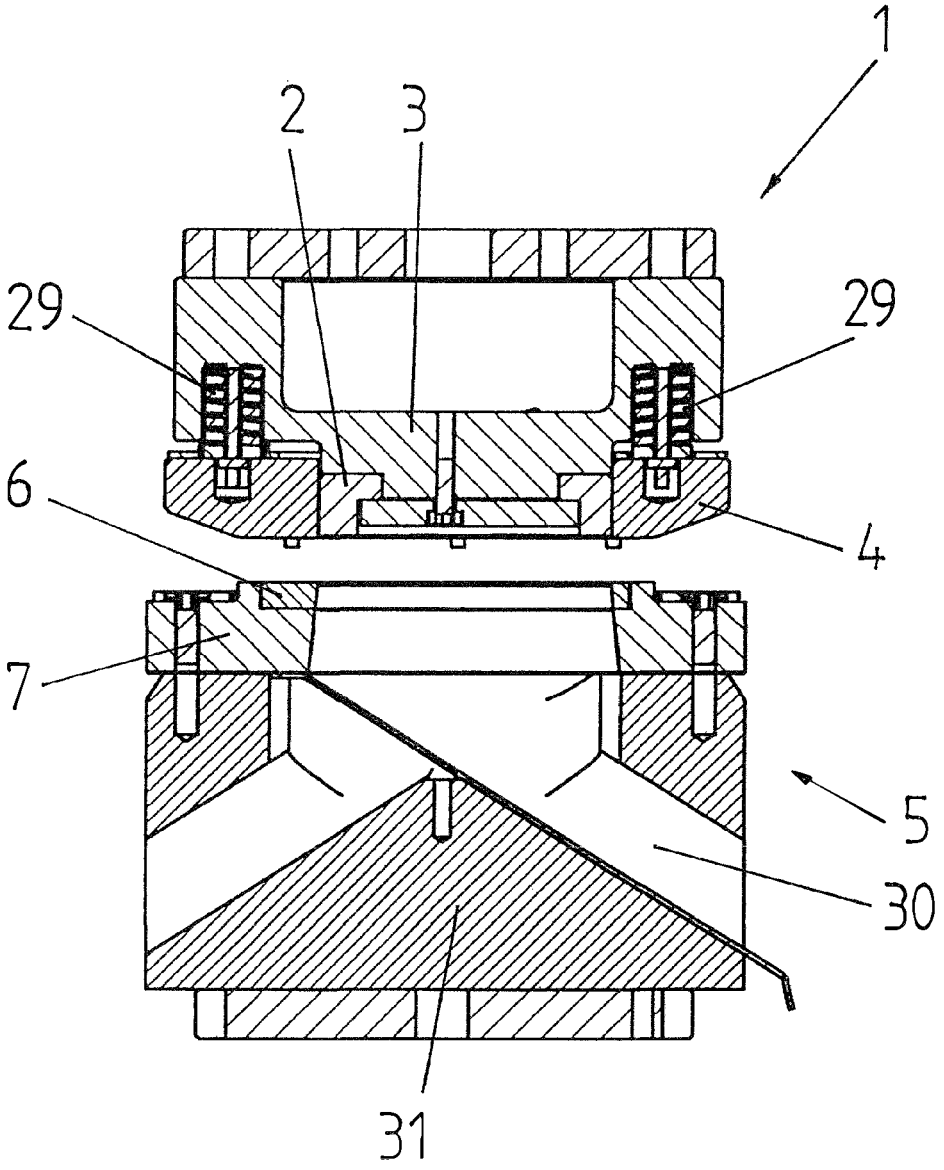
FIGS. 7*a* to 7*e* are vertical sections transverse to the lid transport direction A through the processing tool of the punching processing station 14 of FIG. 6 in tool positions of varying degrees of progress when processing a lid blank according to the state of the art.
Figure 7B:
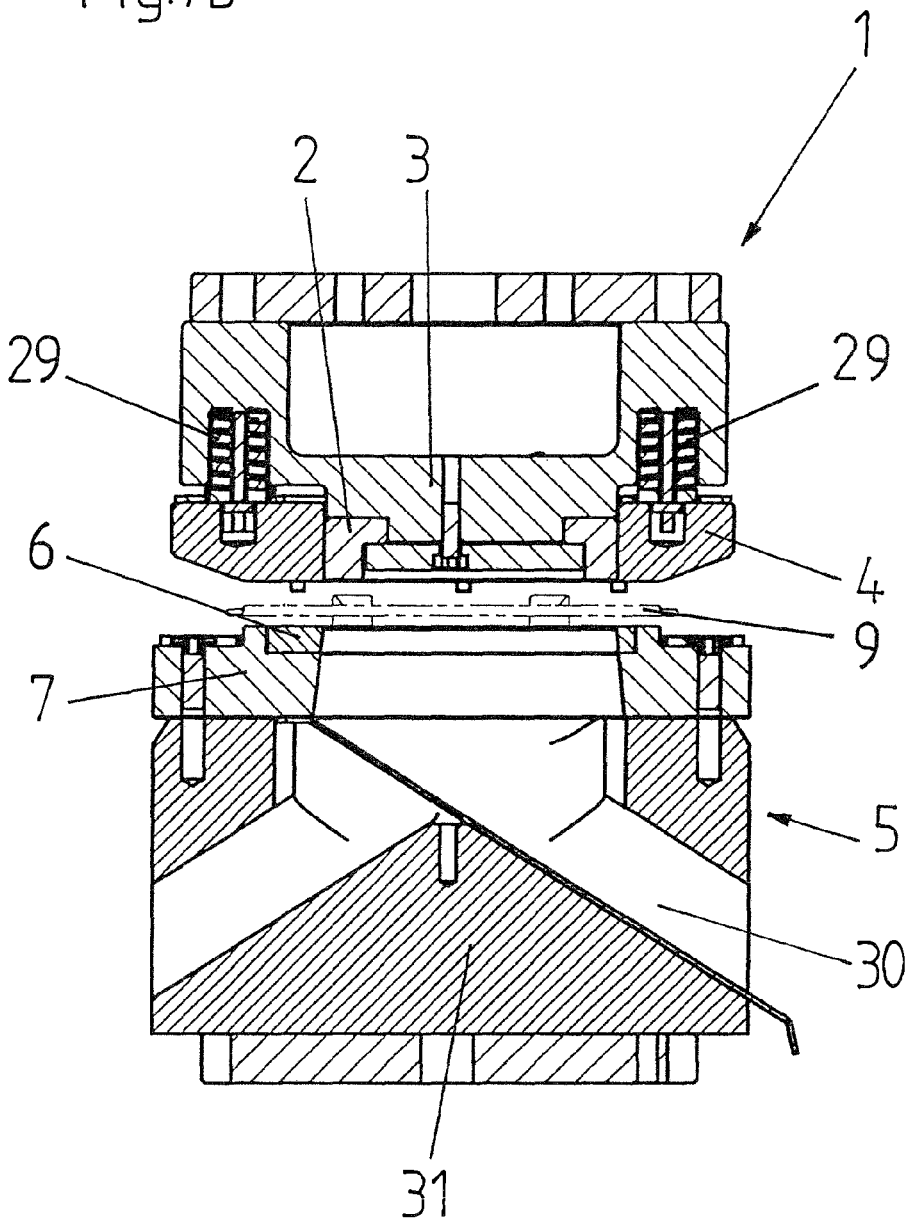

In the introduction, the production of tear-off lids 27 according to the state of the art, as known to the skilled person, is explained with reference to FIGS. 1 to 6. Reference is made to this explanation here in order to avoid repetition.

In the following, the procedure according to the invention is described, whereby reference is made to the known device and the known, previously explained manufacturing steps, as far as this is necessary. In particular, the device and the method according to the invention for forming the lid ring 8 from the lid blank 9 and for sealing the tear-off foil 24 are also proceeded as already known to the skilled person.

FIGS. 7*a* to 7*e* show the machining tool of the punching processing station 14 of FIG. 6 in different advanced tool positions for the machining of a lid blank 9 according to the state of the art.

As can be seen, the tool comprises an upper tool part 1, with a cutting punch 2, 3 comprising a cutting ring 2 and a cutting ring carrier 3 and with a clamping ring 4, and a lower tool part 5, with a die 6 and a die carrier 7.

The upper tool part 1 with the cutting punch 2, 3 is fixed and the lower tool part 5 with the die 6 works against the upper tool part 1.

In the tool position shown in FIG. 7*a*, the tool is open and there is no lid blank 9 in the open tool.

Starting from this situation, a lid blank 9 is inserted into the tool in a horizontal direction (see FIG. 7*b*) in such a way that the side of the lid intended to form the outer side of the lid during the later intended use (intended outer side of the lid) points downwards.

Figure 7C:
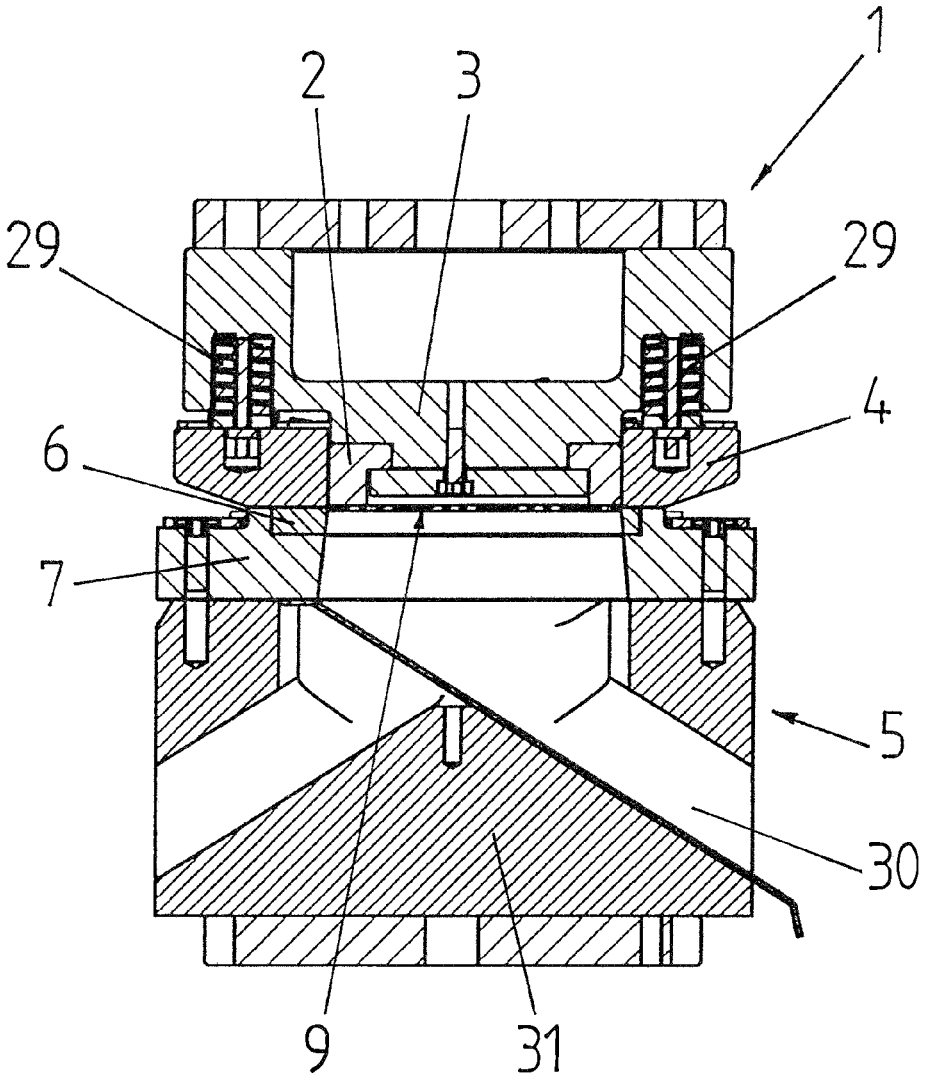

The lower tool part 5 is then moved upwards until the lid blank 9 is clamped between the clamping ring 4 and the die carrier 7 (see FIG. 7*c*).

Figure 7D:
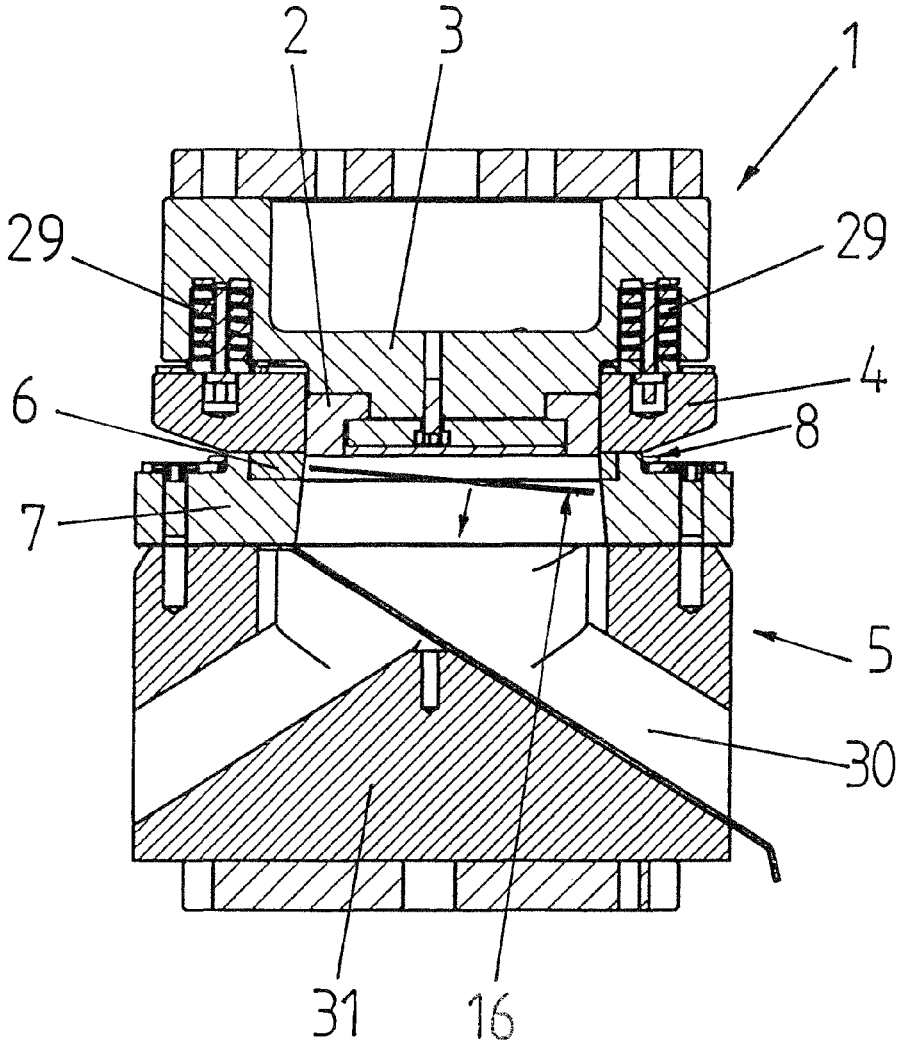

During the subsequent further upward movement of the lower tool part 5, the clamping ring 4 is shifted upwards against the force of compression springs 29, which are arranged in the upper tool part 1, and the cutting punch 2, 3 penetrates the die 6 (see FIG. 7*d*). It punches a punched pad 16 downwards from the lid blank 9, which is discharged by gravity feed via a discharge opening 30 in the base frame 31 of the punch processing station 14 (see FIGS. 7*d* and 7*e*).

Figure 7E:
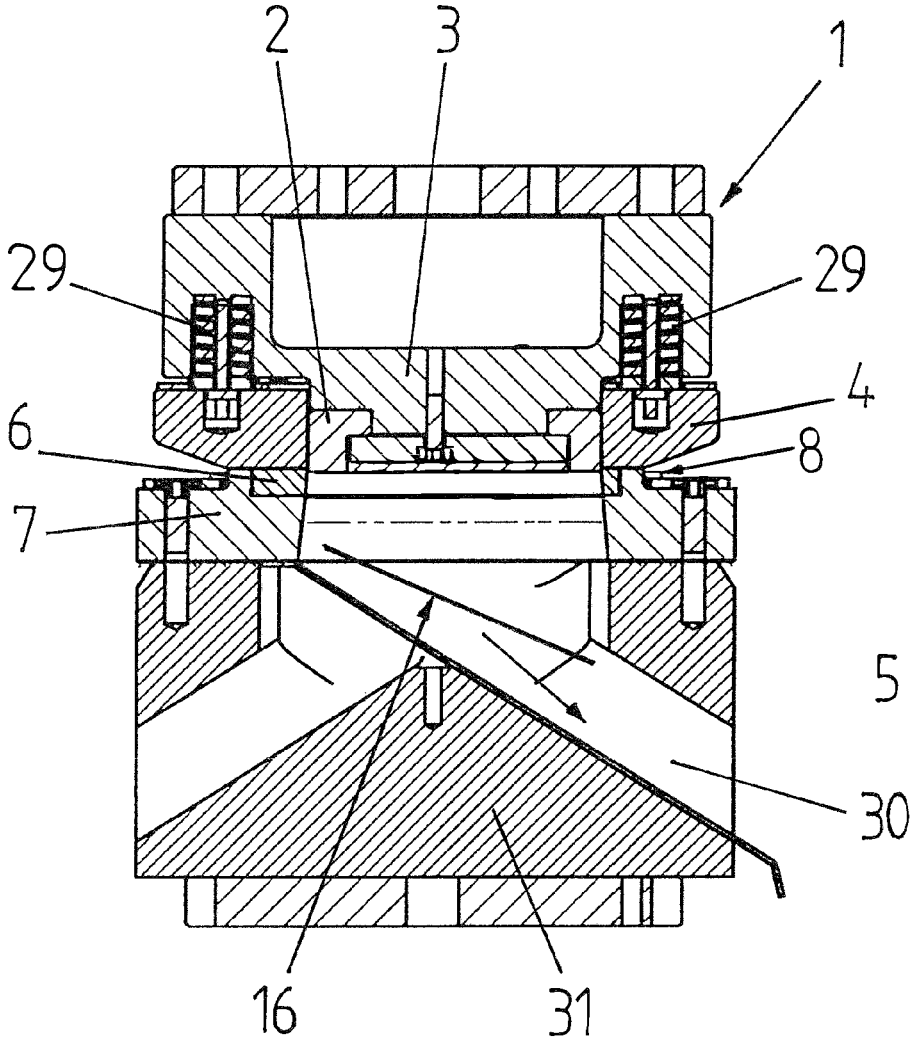

When the die 6 has reached its movement end point relative to the cutting punch 2, 3 as shown in FIG. 7*e*, the lower tool part 5 moves back to the lower position shown in FIG. 7*a* and the lid ring 8 obtained by the punching method is transported to the next processing station 19 by the conveyor 13.

FIGS. 8*a* to 8*e* show vertical sections transverse to the lid transport direction A through the processing tool of the punching processing station with a device according to the invention in tool positions of varying progress in the processing of a lid blank 9. This device differs only in the punching processing station from the device according to the state of the art shown in FIG. 6.

As can be seen, the tool here also comprises a fixed upper tool part 1 and a lower tool part 5, which works against the upper tool part. In contrast to the punch processing station 14 according to FIGS. 7*a*-7*e*, however, the upper tool part 1 here has a die 6 and a die carrier 7 which forms a space 32 above the die 6 into which a vacuum or magnetic conveyor belt 33 projects horizontally in such a way that it essentially completely spans the upwardly pointing opening of the die 6.

The lower tool part 5 has a cutting punch 2, 3 comprising a cutting ring 2 and a cutting ring carrier 3, as well as a clamping ring 4. As can be seen, the cutting ring carrier 3 has internal air ducts 34, which open into several outlet openings 35 located on the upper side of the cutting punch 2, 3.

Figure 8A:
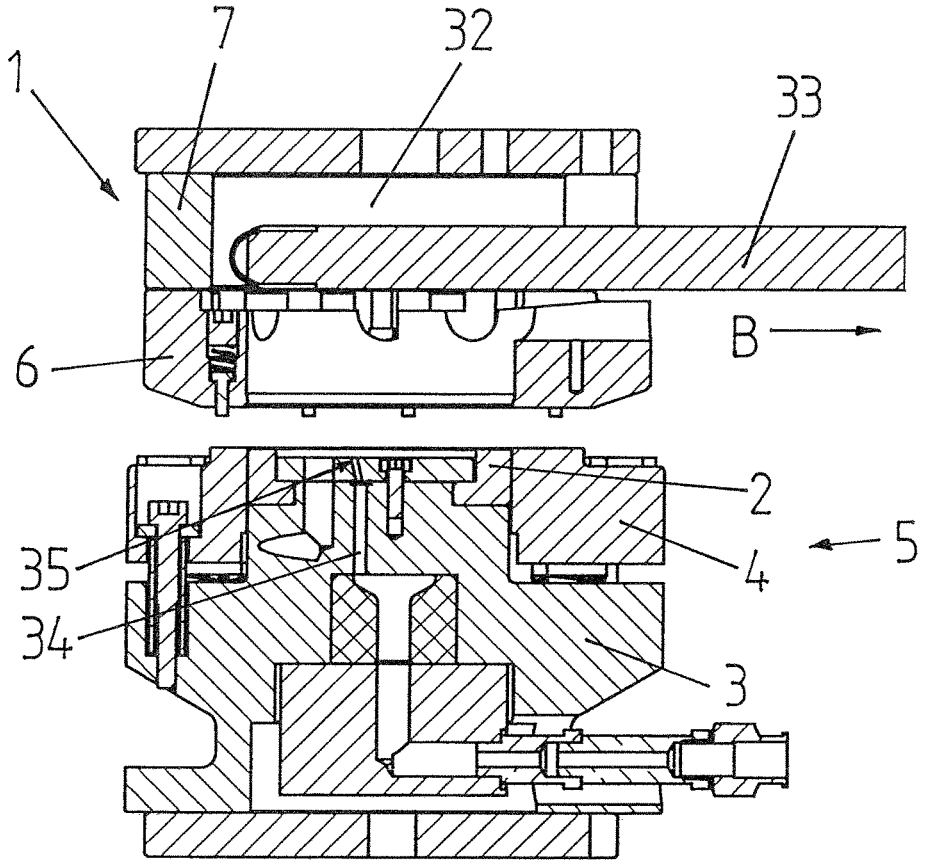
FIGS. 8*a* to 8*e* are vertical sections transverse to the lid transport direction A through the processing tool of the punching processing station in a device according to the invention in tool positions at different stages of progress in the processing of a lid blank according to the invention.
Figure 8B:
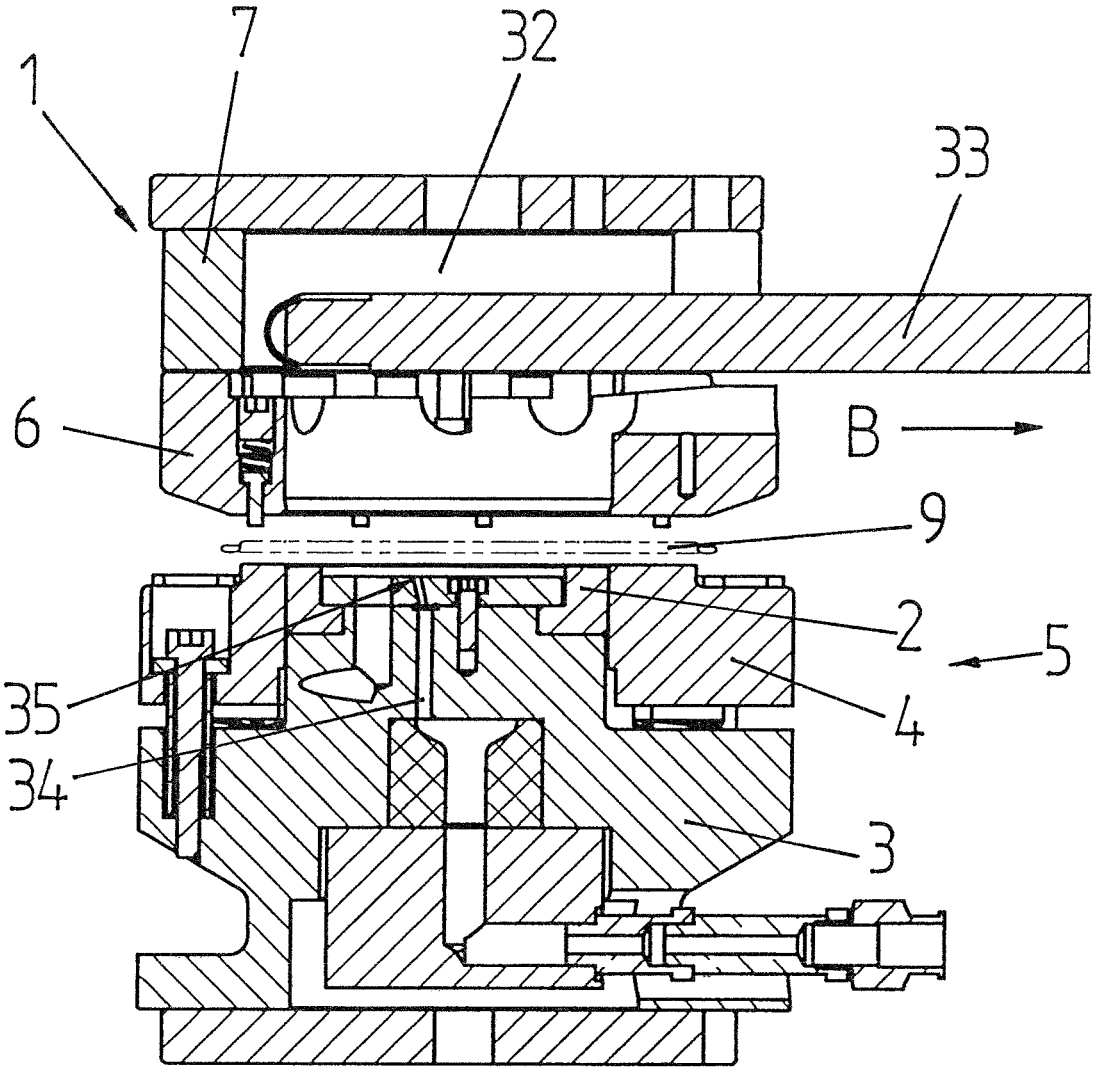

In the tool position shown in FIG. 8*a*, the tool is open and there is no lid blank 9 in the open tool.

Starting from this situation, a lid blank 9 is inserted into the tool in a horizontal direction with the conveyor 13 (see FIG. 8*b*) in such a way that the side of the lid to be produced that forms the outer side of the lid during the later intended use (intended outer side of the lid) points downwards.

Figure 8C:
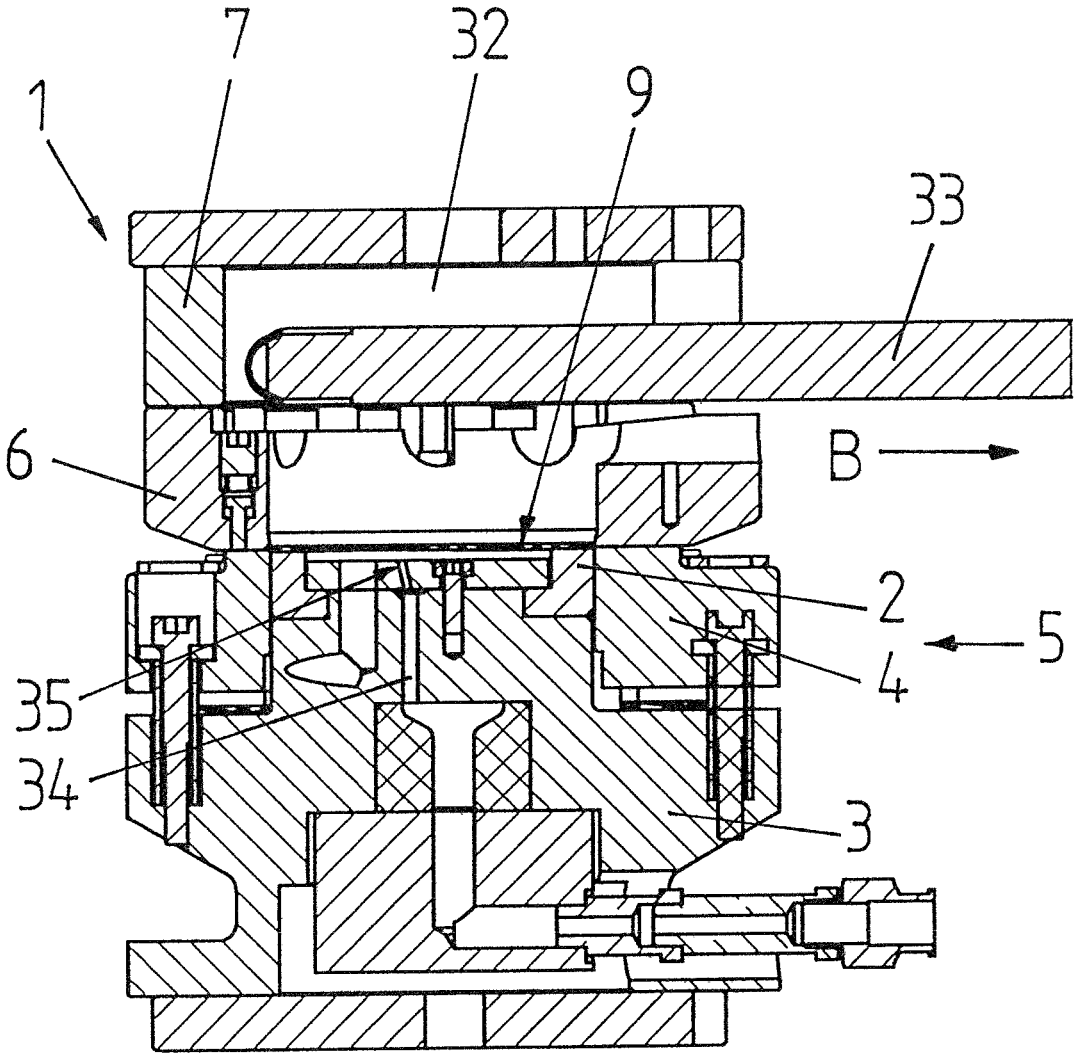
Figure 8D:
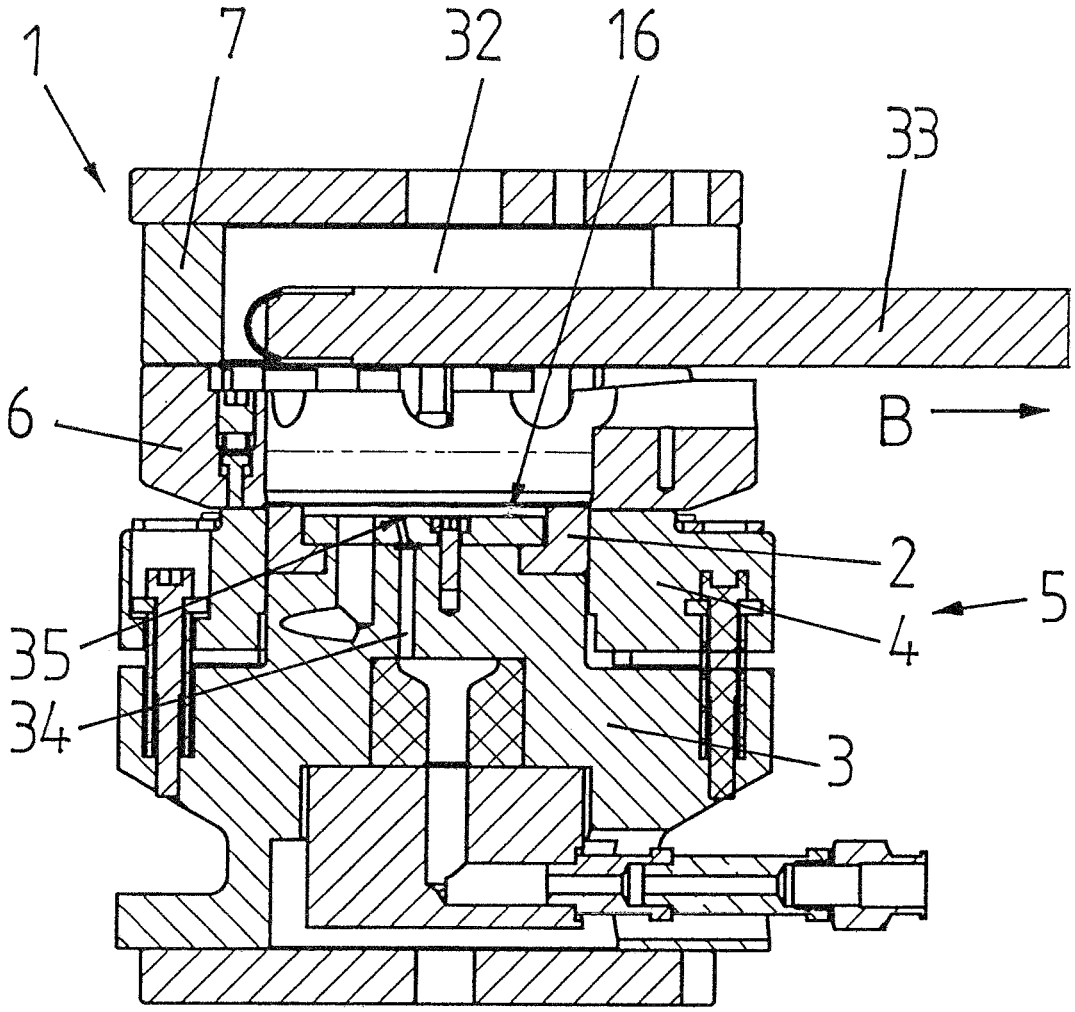

The lower tool part 5 is then moved upwards until the lid blank 9 is clamped between the clamping ring 4 and the die 6 (see FIG. 8*c*).

During the subsequent further upward movement of the lower tool part 5, the cutting punch 2 moves out of the clamping ring 4, which is in contact with the clamped lid blank 9 at the die 6, and enters the die 6. It punches a punched pad 16 out of the lid blank 9 (see FIG. 8*d*).

Figure 8E:
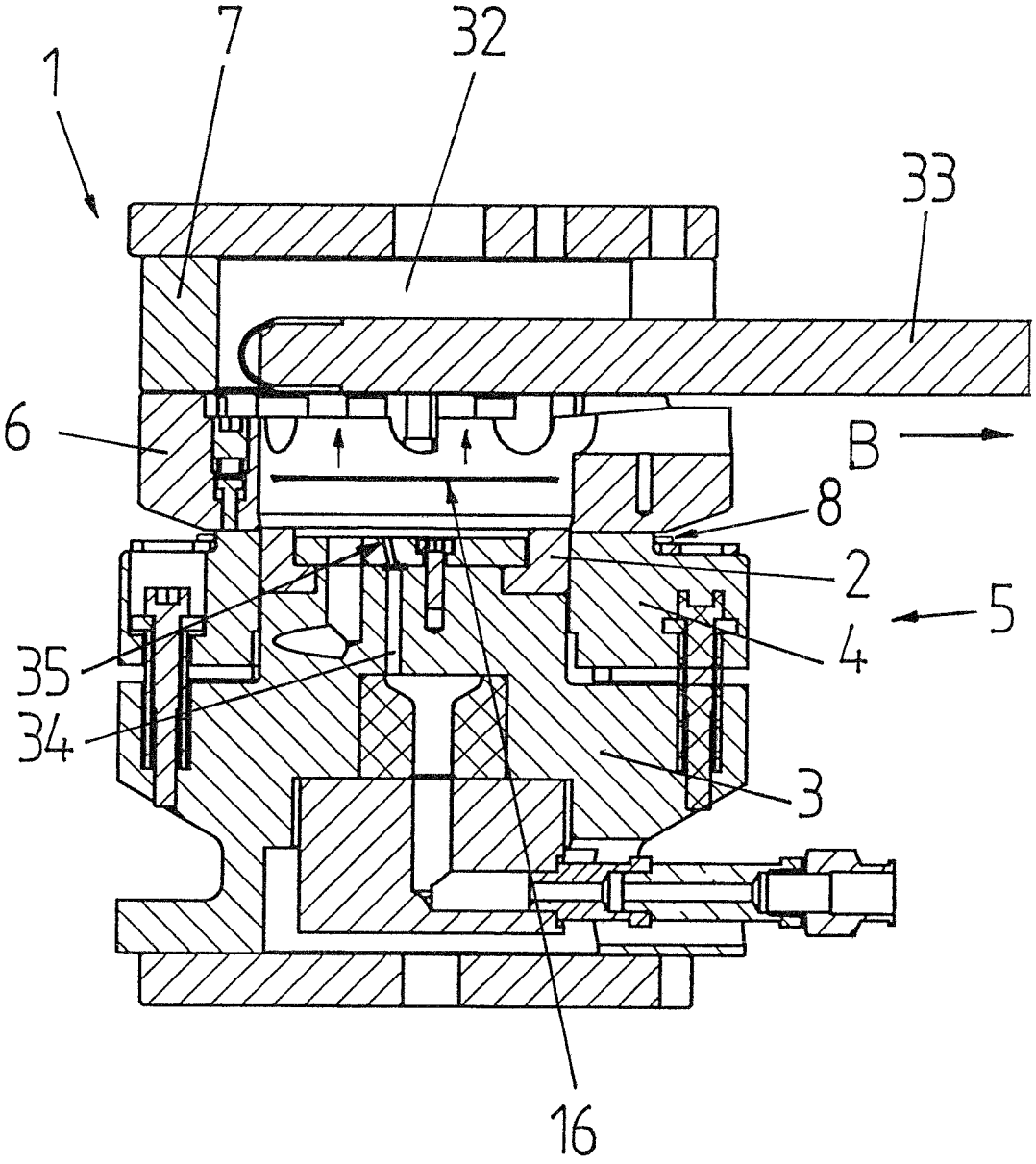

As soon as the cutting punch 2 has reached its end point of movement opposite the die 6, i.e. it is at the top dead center of its movement, as shown in FIG. 8*e*, compressed air is briefly applied to the air ducts 34 in the cutting punch 2, 3. As a result, the punched pad 16 is guided through the die 6 against the vacuum or magnetic conveyor belt 33 and then removed from the tool area by the latter in a direction B, which is transverse to the lid conveying direction A (see FIGS. 6 and 8*e*).

The lower tool part then moves back to the lower position shown in FIG. 8*a* and the lid ring 8 obtained by punching is transported by the conveyor 13 to the next processing station 19.

While the present application describes preferred embodiments of the invention, it should be clearly pointed out that the invention is not limited thereto and can also be implemented in other ways within the scope of the following claims.

The invention claimed is:

1. A method of manufacturing a tear-off lid, comprising the steps of:

forming a lid ring with a central removal opening is surrounded by a sealing flange, by punching a lid blank with a punching tool having a die and a cutting punch, drawing an edge of the removal opening to form a collar projecting from the sealing flange on an intended inner side of the lid ring to a free end, rolling the collar up at its free end; to form a curl, sealing or gluing a tear-off foil onto the sealing flange on the intended outer side of the lid opposite the intended inner side wherein the punching further comprises the steps of:

arranging the die on the intended inner side of the lid during the punching, moving the cutting punch into the die from the intended outer side of the lid to punch out a punched pad, and conveying the punched pad by means of compressed air through the die to a discharge conveyor by means of which the pad is removed from the tool area.

2. The method according to claim 1, wherein the lid blank consists of a ferromagnetic material and the discharge conveyor is a magnetic conveyor belt.

3. The method according to claim 1, wherein the lid blank consists of a ferromagnetic or a non-ferromagnetic material and the discharge conveyor is a vacuum conveyor belt.

4. The method according to claim 1, wherein the compressed air, which is used to convey the punched pad to the discharge conveyor, is supplied through the cutting punch.

5. The method according to claim 4, further including discharging the compressed air passed through the cutting punch from a side of the cutting punch facing the lid blank or the punched pad via one or more outlet openings.

6. The method according to claim 5, including the step of providing the compressed air, which is used for conveying the punched pad to the discharge conveyor, intermittently in such a way that no compressed air is provided when the tool is open and compressed air is provided when the tool is closed.

7. The method according to claim 5, wherein the outlet openings are supplied with compressed air only beginning with the start of the punching or only after the punching has been completed.

8. The method according to claim 2, wherein the rolling includes rolling the collar up towards the removal opening; to form a C-curl or a retort curl.

9. The method according to claim 1, wherein the rolling includes rolling the collar up away from the removal opening, to form a reverse C-curl or to a reverse retort curl.

10. The method according to claim 1, wherein during punching the cutting punch is moved and the die is stationary.

11. The method according to claim 1, wherein during the punching the cutting punch penetrates the die from the bottom to top.

12. The method according to claim 1, wherein the lid ring is turned over between the rolling up of the collar and the sealing or gluing of the tear-off foil.

13. The method according to claim 1, wherein after punching the lid ring is conveyed out of the cutting tool in a first transport direction and the punched pad is removed from the tool area with the discharge conveyor in a second transport direction which runs transversely to the first transport direction.

14. A device for the production of tear-off lids, according to the method of claim 1, the device comprising:

a lid processing conveyor for conveying lid blanks, lid rings and tear-off lids, and processing stations which are provided in succession along the processing conveyor for processing the lid blanks, lid rings, and tear-off lids conveyed by the conveyor, the processing stations including:

a first processing station adapted to form a lid ring with a central removal opening, which is surrounded by a sealing flange, from a lid blank by punching with the punching tool having the die and the cutting punch, a second processing station adapted to form the collar projecting from the lid ring, a third processing station adapted to roll up the collar, and a fourth processing station adapted for sealing or for gluing the tear-off foil onto the sealing flange, and wherein the die of the first processing station is arranged on the intended inner side of the lid and the cutting punch is moved into the die from the intended outer side of the lid for punching out a punched pad, wherein the first processing station further includes a discharge conveyor for removing the punched pad from the tool area during operation of the device, and passageways to convey the punched pad by means of compressed air through the die to the discharge conveyor.

15. The device according to claim 14, wherein the discharge conveyor comprises a magnetic conveyor belt or a vacuum conveyor belt.

16. The device according to claim 14, wherein the cutting punch has one or more air ducts for transporting the compressed air, which is used in intended operation to convey the punched pad by means of compressed air through the die to the discharge conveyor.

17. The device according to claim 16, wherein the cutting punch has on one side facing the lid blank or the punched pad one or more outlet openings for the transport of compressed air.

18. The device according to claim 14, wherein the device has a control device by means of which the compressed air used for conveying the punched pad to the discharge conveyor is intermittently provided in such a way that when the tool is open, no compressed air is provided and when the tool is closed, compressed air is provided.

19. The device according to claim 14, wherein the third processing station is designed to roll up the collar towards the removal opening as a C-curl or a retort curl.

20. The device according to claim 14, wherein the third processing station is adapted to roll up the collar away from the removal opening as a reverse C-curl or a reverse retort curl.

21. The device according to claim 14, wherein the cutting punch is moved movable and the die is stationary.

22. The device according to claim 14, wherein during punching the cutting punch of the first processing station penetrates the die from bottom to top.

23. The device according to claim 14, wherein a turning station is provided between the third processing station and the fourth processing station for turning the lid ring.

24. The device according to claim 14 wherein the lid processing conveyor has a first transport direction and the discharge conveyor has a second transport direction which runs transversely to the first transport direction.

25. A punching processing station for forming a lid ring with a central removal opening, which is surrounded by a sealing flange from a lid blank by punching, comprising:

a punching tool with a stationary die and a cutting that works from below against the die and thereby enters the die while punching out a punched pad; and devices for conveying the punched pad by means of compressed air against gravity through the die to a discharge conveyor assigned to the punching processing station for removing the punched pad from the tool area.

* * * * *